US007380287B2

(12) United States Patent
DeSantis

(10) Patent No.: US 7,380,287 B2
(45) **Date of Patent: *Jun. 3, 2008**

(54) LONG-SLEEVED GARMENT WITH WRISTWATCH ACCOMMODATIONS

(75) Inventor: Carl A. DeSantis, Palm Beach, FL (US)

(73) Assignee: Hassler Consortium, Inc., Boca Raton, FL (US)

( * ) Notice: Subject to any disclaimer, the term of this patent is extended or adjusted under 35 U.S.C. 154(b) by 131 days.

This patent is subject to a terminal disclaimer.

(21) Appl. No.: 11/173,128

(22) Filed: Jul. 1, 2005

(65) Prior Publication Data

US 2005/0217005 A1 Oct. 6, 2005

Related U.S. Application Data

(63) Continuation of application No. 10/870,846, filed on Jun. 17, 2004, now Pat. No. 7,120,936.

(51) Int. Cl.
*A41B 7/00* (2006.01)

(52) U.S. Cl. ..... 2/123

(58) Field of Classification Search ..... 2/69, 2/77, 85, 93, 94, 101, 106, 108, 123–126, 2/160, 170, 244, 245, 247, 249, 60; 224/171
See application file for complete search history.

(56) References Cited

U.S. PATENT DOCUMENTS

| | | | | |
|---|---|---|---|---|
| 0,979,306 A | | 12/1910 | Smiddy | |
| 1,209,798 A | * | 12/1916 | Apichella | 2/123 |
| 1,483,731 A | | 2/1924 | Kirk | |
| 1,504,115 A | | 8/1924 | Flora | |
| 1,691,958 A | * | 11/1928 | Bostick | 2/123 |
| 2,042,567 A | * | 6/1936 | Trieschmann | 2/60 |
| 2,103,711 A | | 12/1937 | Cole | |
| 2,333,428 A | | 11/1943 | Kinsey | |
| 2,843,849 A | * | 7/1958 | Stevenson | 2/123 |
| 2,876,456 A | | 3/1959 | Johnson | |
| D193,760 S | | 10/1962 | Sanders | |
| 3,137,861 A | * | 6/1964 | Sanders | 2/123 |
| 3,193,842 A | | 7/1965 | Bell | |
| D207,090 S | | 3/1967 | Kay | |
| 3,419,908 A | | 1/1969 | Germani | |
| 4,155,219 A | | 5/1979 | Anderson | |
| 4,387,838 A | | 6/1983 | Jackson | |

(Continued)

FOREIGN PATENT DOCUMENTS

CH 694 747 A 7/2005

(Continued)

*Primary Examiner*—Alissa L Hoey
(74) *Attorney, Agent, or Firm*—Dennis T. Griggs

(57) ABSTRACT

A long sleeved garment has a sleeve that is fitted with a watch cuff which accommodates a wristwatch so that the face of the watch will be readily visible and accessible through a viewing window at all times, and not obscured by the cuff, while preserving the tailored appearance of the garment. In a barrel cuff embodiment, a cutout opening intersects the distal edge of a cuff and extends inwardly along a curved cut line, thereby defining the interior boundary of an open viewing window. In a French cuff embodiment, an outer cuff fold layer is intersected by a cutout opening that forms a window through which a wristwatch can be viewed.

15 Claims, 5 Drawing Sheets

U.S. PATENT DOCUMENTS

| | | | | |
|---|---|---|---|---|
| 4,603,440 | A | 8/1986 | Hale | |
| 4,862,521 | A | 9/1989 | Mann | |
| 5,035,000 | A | 7/1991 | Mathias | |
| 5,067,177 | A | 11/1991 | Binder | |
| 5,073,987 | A | 12/1991 | Crosier | |
| 5,173,968 | A | 12/1992 | Fox | |
| 5,332,135 | A | 7/1994 | Fletcher | |
| 5,477,633 | A | 12/1995 | Leinberger | |
| 5,555,561 | A | 9/1996 | Plachta et al. | |
| 5,610,877 | A | 3/1997 | Adams et al. | |
| 5,671,481 | A | 9/1997 | Giard | |
| 5,704,067 | A | 1/1998 | Brady | |
| 5,812,500 | A | 9/1998 | Webb, Jr. | |
| 5,838,642 | A | 11/1998 | Tully | |
| 5,924,135 | A | 7/1999 | Worth | |
| 6,199,730 | B1 | 3/2001 | Chisolm | |
| 6,212,685 | B1 | 4/2001 | Kelly | |
| 6,227,424 | B1 | 5/2001 | Roegner | |
| 6,430,747 | B1 * | 8/2002 | Lee | 2/60 |
| 6,519,207 | B1 | 2/2003 | Lukacsko | |
| 6,799,887 | B1 | 10/2004 | Kinney | |
| 7,017,191 | B2 * | 3/2006 | Golde | 2/93 |
| 7,120,936 | B2 * | 10/2006 | DeSantis | 2/123 |
| 2002/0020001 | A1 | 2/2002 | Kelley | |
| 2002/0073475 | A1 | 6/2002 | Bloom et al. | |
| 2003/0182714 | A1 | 10/2003 | Mariland et al. | |
| 2006/0101554 | A1 * | 5/2006 | St-Germain | 2/123 |

FOREIGN PATENT DOCUMENTS

| | | | |
|---|---|---|---|
| FR | 2670368 | A | 6/1992 |
| GB | 710 394 | A | 6/1954 |
| JP | 49-101142 | | 9/1974 |
| JP | 01-168502 | | 11/1989 |
| JP | 2003041402 | A | 2/2003 |
| JP | 2004256968 | A | 9/2004 |

* cited by examiner

LONG-SLEEVED GARMENT WITH WRISTWATCH ACCOMMODATIONS

CROSS-REFERENCE TO RELATED APPLICATION

This application is a continuation of U.S. application Ser. No. 10/870,846 filed Jun. 17, 2004, now U.S. Pat. No. 7,120,936 issued Oct. 17, 2006.

BACKGROUND OF THE INVENTION

1. Field of the Invention

This invention is related generally to wearing apparel, and in particular to a shirt cuff having means for retaining and displaying a conventional wristwatch so that it can be viewed conveniently without retracting the cuff.

2. Description of the Related Art

The shirt as it is known today actually began as an undergarment in the form of a soft tunic that was worn as a protective layer beneath outer clothing. With a collar extending above the neck and cuffs covering the wrists, it was a safeguard against irritation from coarse woolens. Although shirt sleeve cuffs in some form have likely existed throughout history, their fashionable origins are said to have followed the style of early military garments in which a protective sleeve extension or cuff of mail was sewn onto the tunic sleeves. That short cuff was intended as a defensive measure to shield the portion of wrist exposed between the lower forearm and a heavy leather glove (gauntlet) covering the hand.

As mail and other body armor became obsolete, military uniforms evolved and the short mail cuff was replaced by a turned-up portion of the shirt sleeve or a separate sewn-on fabric extension of the sleeve. Military costume styles continued to set the standard in all essentials for fine clothing, and this fabric cuff arrangement was soon imitated in the design of civilian shirts. Ultimately, the exposed collar and cuff portions of the shirt began to be viewed as both decorative and fashionable, indicating one's wealth and social position.

Today, the modern cuff is intentionally made visible as a band of linen between the outer coat sleeve and hand, and has become a stylistic gesture associated with the well-dressed man. In a tailored suit jacket and shirt combination, the jacket sleeve should extend to where the wrist joins with the hand. According to contemporary standards for men's clothing, this length should reveal about one-half inch of the shirt cuff. The band of linen between sleeve and hand, like that above the jacket collar, is one of the details that defines the sophisticated dresser. Cuffs now come in two basic types, the barrel cuff extension and the French cuff extension. The barrel cuff fastens by one or two buttons, while the French cuff folds back onto itself and is held together by a cufflink.

Along with tailored suit jackets and shirts, the wristwatch has become a standard fashion accessory. This is due to the fact that the wristwatch chronometer has more than just a practical function. The wristwatch, having replaced the pocket watch as the symbol of competence and efficiency, has also become a fashion statement and a status symbol. This is no less true for women than for men, but it probably has more impact on men, who tend to wear far less jewelry. In the same way that properly fitted shirt cuffs and collars have become important fashion indicators, the wearing of a fine wristwatch is one of the subtle ways a man can signal his values and standing in society.

The cuff and wristwatch, both encircling the wrist, thus compete for viewing attention, and it is necessary to retract the cuff to provide a clear view and access to the time display and control features of the wristwatch.

Aside from fashion watches, it has become common for persons to wear wrist-mounted devices such as multifunction wristwatches, wireless communication units, calculators, heart rate monitors and the like that require immediate access for viewing and control. Accordingly, there is a continuing interest in providing an apparel cuff that satisfies the competing requirements of utility and fashion for various wrist-mounted devices, as well as for fashion watches.

Of particular interest is the need for a shirt cuff that will accommodate viewing and access requirements for a wristwatch or other wrist-mounted instrument and present the indicating face of the watch or instrument so that it is readily visible and accessible at all times, and not obscured by the shirt cuff, while preserving the tailored appearance of the cuff, for both men's and women's fashion apparel.

Conventional wristwatches and wrist-mounted instruments are worn in direct skin contact against the wrist, and so are exposed to frictional contact, perspiration moisture and body heat. Corrosive salt compounds present in perspiration may rust the watch body and penetrate into the watch movement or instrument, thus impairing operation and leading to premature failure. Penetration of perspiration moisture into the bezel pocket can cause discoloration of the dial face and cause a film of moisture to accumulate on the underside of the crystal, thus interfering with observation.

Moreover, the user's perspiration may react with the metal body or finish of the wrist-mounted instrument, thus producing an acid compound that may irritate sensitive skin and cause an allergic reaction. The acid compound may also attack the finish of the watch body and connecting straps, thus tarnishing its appearance and reducing its auction value. Accordingly, there is a continuing interest in providing a shirt cuff that opposes the direct transfer of perspiration moisture to the watch and allows a wristwatch or other wrist-mounted instrument to be loosely associated with the wrist and worn with utmost comfort and confidence, without direct contact by the watch body against the wearer's wrist.

A conventional wristwatch or wrist-mounted instrument is secured onto the wrist by means of leather straps, or an elastic expansion band, that holds the watch body tightly against the wrist, thus concentrating the compressive force of engagement primarily against the skin of the wrist directly facing the watch body. This can cause chafing and loss of normal blood circulation through veins and capillaries near the skin surface, resulting in some discomfort and loss of full wrist movement and flexibility, as well interfering with access to control buttons and knobs. Accordingly, there is a continuing interest in providing a shirt cuff that spreads the forces of expansion band or strap engagement more or less uniformly around a substantial portion of the wrist, thus avoiding the constricting effects of concentrated engagement forces imposed by conventional strap and banding arrangements.

There is also an interest in providing a shirt cuff that allows a wristwatch or other wrist-mounted instrument to be loosely associated with the wrist and worn with utmost comfort and confidence, without turning or slipping from a preferred viewing position.

There is a further interest in providing a shirt cuff that allows a wristwatch or other wrist-mounted instrument to be loosely associated with the wrist and worn with utmost comfort and confidence, while providing a ventilation passage between the wrist and watch body that opposes heat transfer to the watch body, and opposes the transfer of perspiration moisture to the watch body.

There is also an interest in providing a shirt cuff that allows the body of a wristwatch or other wrist-mounted instrument to be worn without direct contact with the wrist, and which can be secured with conventional elastic bands or straps without interfering with normal assembly and release, so that the wristwatch can be readily secured around and removed from the wrist, conveniently and at will.

BRIEF SUMMARY OF THE INVENTION

The present invention provides a cuff for a long sleeved shirt or similar garment having means for displaying a conventional wristwatch or other wrist-mounted instrument. In a first embodiment, the watch cuff includes a fabric band that is intersected by a cut-out opening forming a viewing window through which the body of a conventional wristwatch can be viewed and accessed when the watch is worn on the wrist in the normal display position. After the watch band is secured around the user's wrist in the usual way by means of a conventional strap or expansion band, the face of the watch will be readily visible and accessible through the viewing window at all times, and not obscured by the shirt cuff, while preserving the tailored appearance of the cuff.

In an alternative embodiment, the watch cuff is provided with a fabric band that is intersected by a cut-out opening forming a viewing window through which the body of a conventional wristwatch can be viewed and accessed. A flexible fabric flap is attached onto the band and is folded underneath the viewing window, thereby providing a saddle for engaging and supporting the watch body in a position in which it can be viewed through the viewing window. The saddle flap opposes the direct transfer of perspiration moisture to the watch and allows a wristwatch or other wrist-mounted instrument to be loosely associated with the wrist and worn with utmost comfort and confidence, while preventing direct contact by the watch body against the wearer's wrist.

In another embodiment of the present invention, the watch cuff is provided by a cuff that includes a fabric band portion that is foldable to form the inner and outer layers of a French-style cuff. The outer layer of the band is intersected by a cut-out opening that provides a viewing window through which the body of a conventional wristwatch can be viewed and accessed. The inner layer of the French cuff serves as a saddle for engaging and supporting the watch body in registration with the viewing window, thus providing convenient viewing and access. In that embodiment, the forces imposed by an expansion band or strap engagement are spread more or less uniformly through the cuff around a substantial portion of the wrist, thus avoiding the constriction effects of engagement forces.

BRIEF DESCRIPTION OF THE SEVERAL VIEWS OF THE DRAWING

The accompanying drawing is incorporated into and forms a part of the specification to illustrate the preferred embodiments of the present invention. Various advantages and features of the invention will be understood from the following detailed description taken with reference to the attached drawing figures in which.

DETAILED DESCRIPTION OF THE INVENTION

Figure 1:
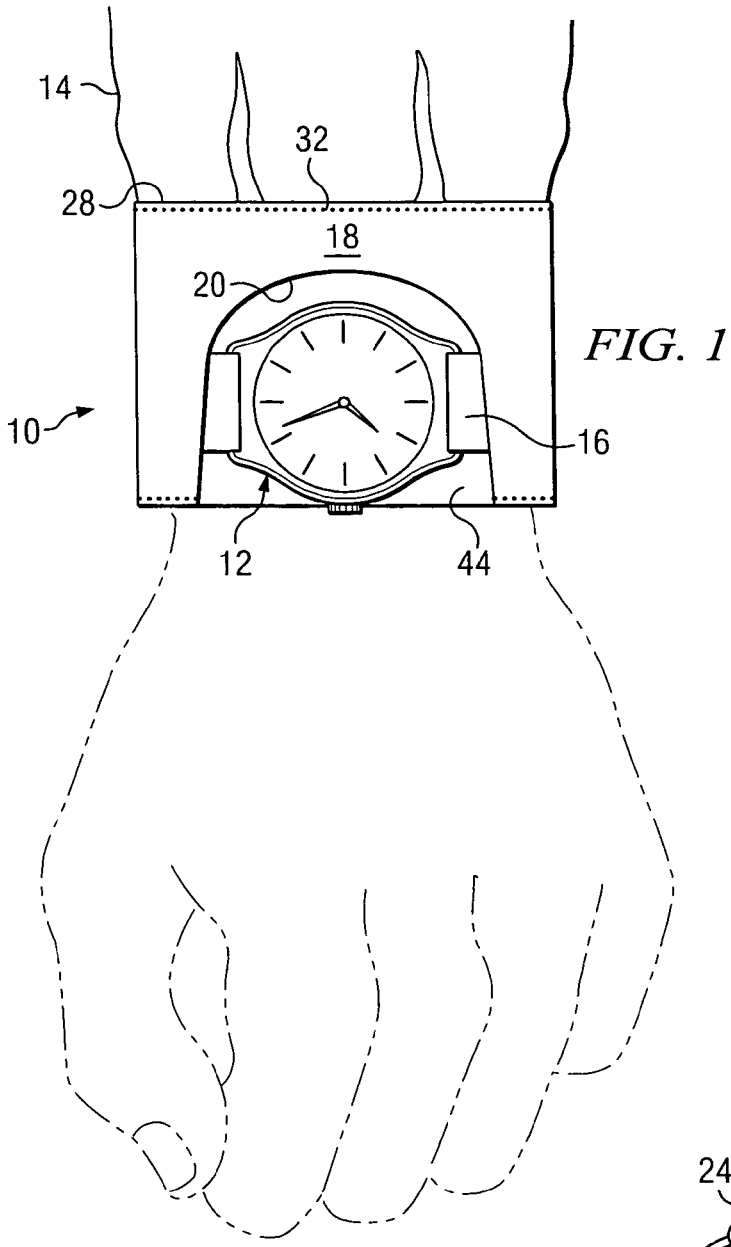
FIG. 1 is perspective view of a watch cuff constructed according to one embodiment of the invention.

Preferred embodiments of the invention will now be described with reference to various examples of how the invention can best be made and used. Like reference numerals are used throughout the description and several views of the drawing to indicate like or corresponding parts.

Figure 4:
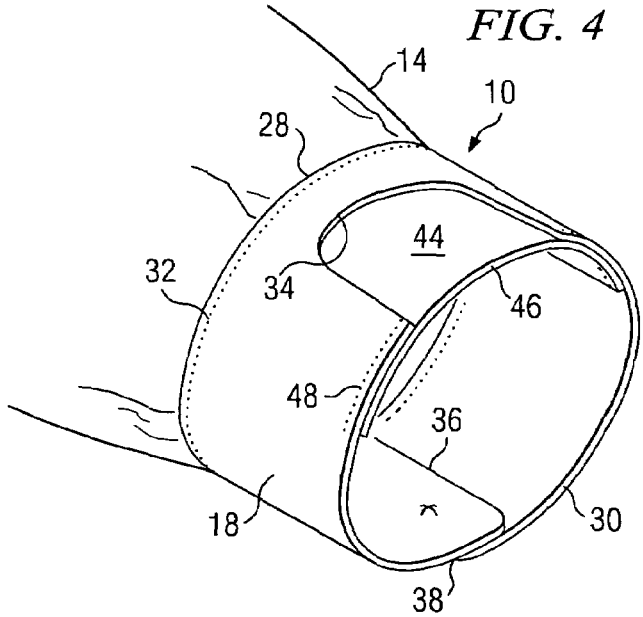
FIG. 4 is a perspective view of the watch cuff stitched to a shirt sleeve in a barrel cuff extension embodiment.

Referring now to FIG. 1 and FIG. 4, a watch cuff 10, having means for displaying a conventional wristwatch 12 or other wrist-mounted instrument, is attached as a barrel cuff extension on a sleeve 14 of a long-sleeved shirt or similar garment, for example a man's dress shirt. The watch cuff 10 will accommodate a wristwatch 12 having a conventional strap 16 or expansion band for retaining the watch in an operative viewing position on the wrist of a wearer.

The watch cuff 10 includes a cuff band 18 that is intersected by a cut-out opening 20 forming a viewing window 22 through which the body 24 and face 26 of a wristwatch or other wrist-mounted instrument can be viewed and accessed when the watch is worn on the wrist in the normal operative display position. The cuff band 18 is delimited on one end by a linear edge portion 28 defining a proximal end of the cuff and on the opposite end by a linear edge portion 30 defining a distal end of the cuff. The proximal end portion 28 is attached to the shirt sleeve by conventional stitching 32, thus forming a barrel extension of the sleeve. The linear edge portion 30 on the distal end is intersected by an inwardly directed, curved cut line 34 that is contoured to define the profile of the viewing window 22.

The "operative display position" is illustrated in FIG. 1. As used herein, "operative display position" refers to the location of the watch body 24 as it is retained by straps 16 or an expansion band closely adjacent the juncture of the wrist and hand, with the face 26 of the watch being presented for viewing on the top side of the wrist and hand.

The watch 12 is secured around the user's wrist in the usual way by retaining means 16 in the form of a conventional strap, clasp or expansion band. The face 26 of the wristwatch will be readily visible and accessible through the viewing window 22 at all times, and will not be obscured by the cuff band 18, while preserving the tailored appearance of the cuff.

Figure 3:
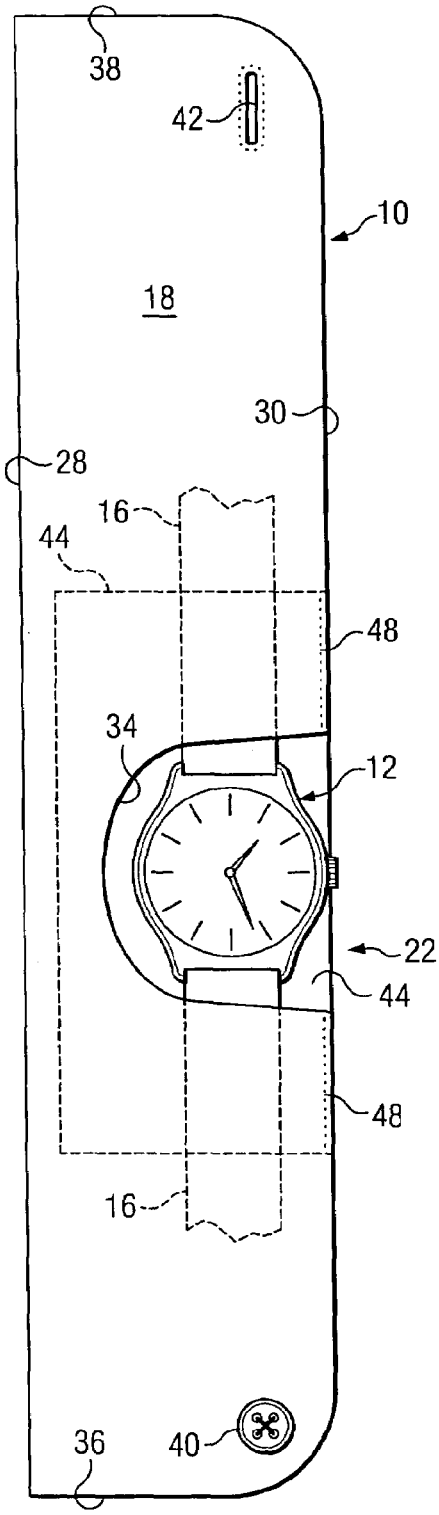
FIG. 3 is a top plan view of the watch cuff of FIG. 1, shown prior to attachment to a shirt sleeve.
Figure 5:
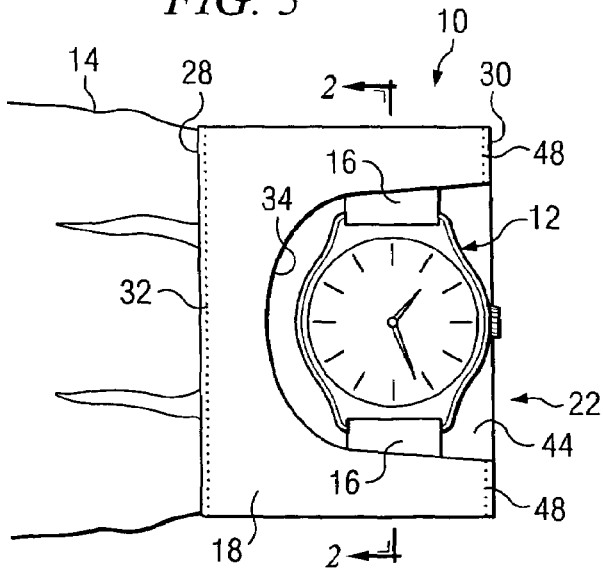
FIG. 5 is a top plan view of the watch cuff and sleeve shown in FIG. 4, with a wristwatch disposed in a viewing window.

Referring now to FIG. 3, the cuff band 18 has first and second side portions 36, 38 that are rolled and gathered to form a barrel cuff extension of the shirt sleeve. The side portions are secured together by a conventional button 40 and button hole 42 combination as shown in FIG. 4 and FIG. 5. Preferably, the cuff band 18 is formed of a flexible two-ply fabric material, for example woven cotton yarn, and is shaped to encircle the wrist of a wearer.

The cut-out opening 20 intersects the distal edge and extends inwardly along the curved cut line 42, thereby defining the interior boundary of the viewing window 22. The viewing window is slightly oversized relative to the watch body 22 to fully expose the face 26 of the wristwatch for viewing while it is being worn in the operative viewing position. According to this arrangement only a small portion of the attachment strap 16 is exposed to view, with most of the strap being concealed beneath the cuff band 18.

Figure 2:
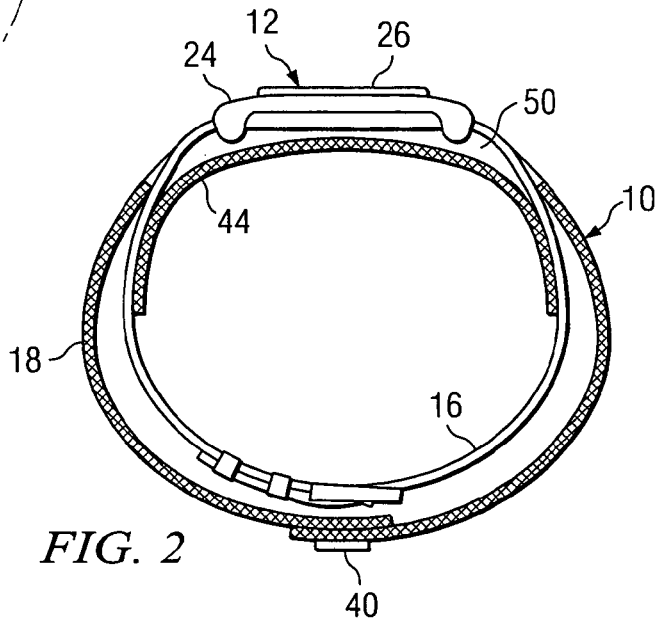
FIG. 2 is a cross sectional view taken along line 2-2 of FIG. 5.

According to an alternative embodiment, a flexible flap 44 is attached to the cuff band 18 and is folded beneath the viewing window 22, as shown in FIG. 2, FIG. 3 and FIG. 4, thereby providing a saddle for engaging and supporting the watch body 24 in the operative display position. The saddle flap 44 allows a wristwatch or other wrist-mounted instrument to be loosely associated with the wrist and worn with utmost comfort and confidence, while preventing engagement of the watch body 24 against the wearer's wrist. That is, the saddle flap 44 provides a soft barrier layer preventing direct contact between the wristwatch and the wearer's wrist. Preferably, the saddle flap 44 is cut from a swatch of two-ply, 100 percent woven cotton yarn having a yarn threads per-inch count in the range of from about 80 threads per-inch to about 220 threads per-inch.

Figure 6:
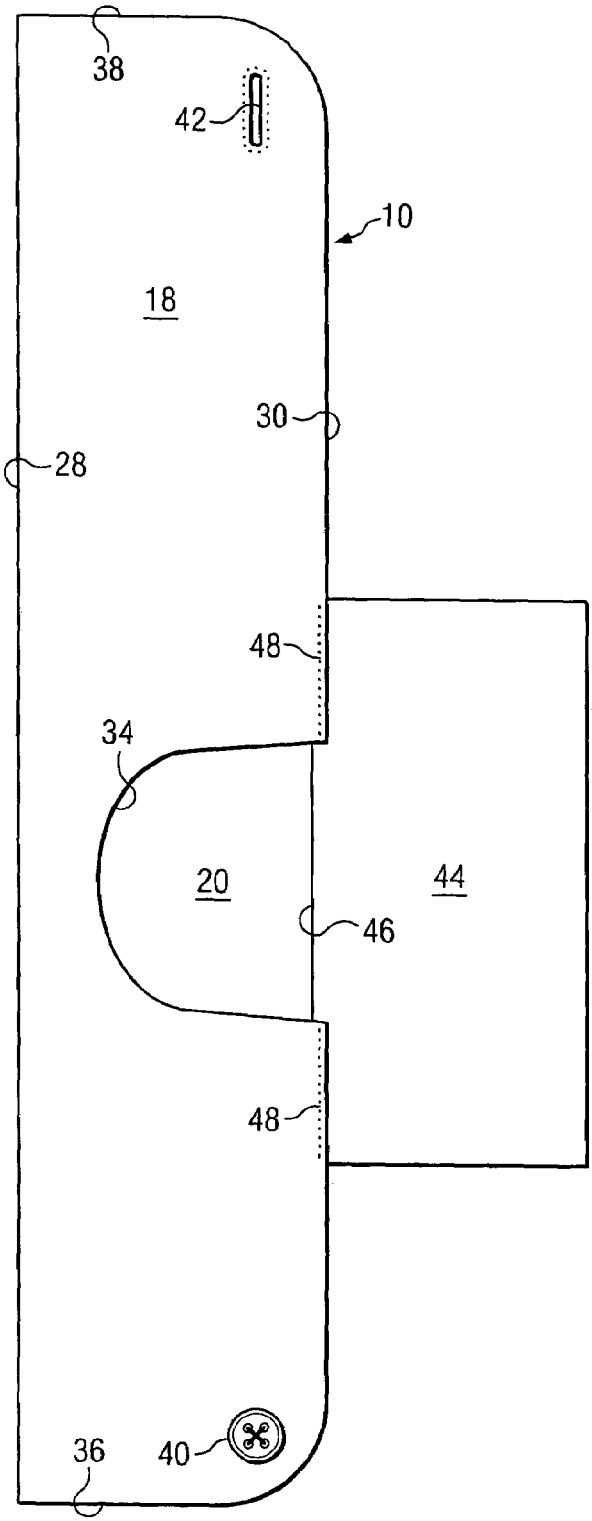
FIG. 6 is a top plan view of the watch cuff of FIG. 1, shown with the saddle flap extended.
Figure 7:
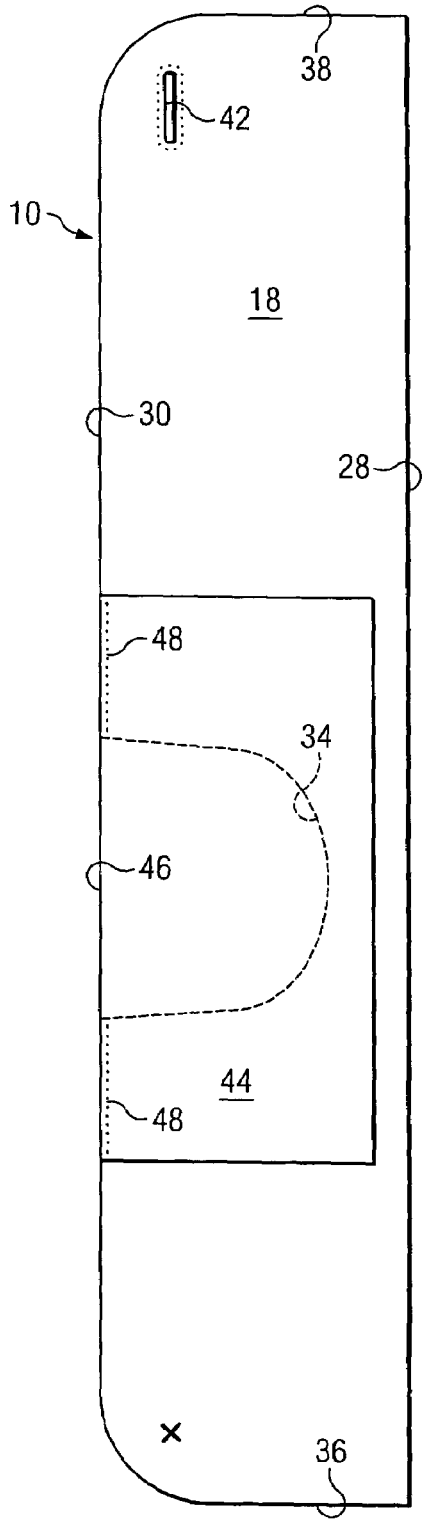
FIG. 7 is a bottom plan view of the watch cuff of FIG. 1, shown with the saddle flap folded beneath the watch cuff and viewing window.

Referring now to FIG. 3, FIG. 6 and FIG. 7, the saddle flap 44 is movably coupled in depending relation to the cuff band 18 to allow placement of a watch body over the saddle flap and positioned in viewing registration within the window opening 20. Preferably, the saddle flap 44 is a rectangular swatch of two-ply fabric material that is bounded on at least one side by a linear side edge portion 46. As shown in the top plan view of FIG. 6, the saddle flap is movably coupled to the cuff band 18 and can be extended away from the linear edge portion and window opening to allow initial placement of the wristwatch. After the wristwatch is positioned in the viewing window 22, the saddle flap 44 is folded under in subjacent relation with the watch body 24 and cuff band, as shown in FIG. 3. The saddle flap is attached by stitching 48 along its linear side edge 46 onto to the cuff band in alignment with the distal edge portion 30 of the cuff.

Referring again to FIG. 2 and FIG. 4, the saddle flap 44 is disposed in subjacent supporting relation with the watch body 24 and extends across the viewing window 22 and circumferentially around about one-half of the wrist. According to this arrangement, the saddle flap 44 is positioned intermediate the wrist and the watch body 24, thus opposing the direct transfer of perspiration moisture from the wrist to the watch body. Because of the loose fitting of the watch around the saddle flap 44, a small ventilation passage 50 is formed between the wrist and the watch body that opposes heat transfer to the watch body, and prevents frictional contact of the watch body against the wrist. Moreover, the compressive forces imposed by expansion band or strap engagement are spread more or less uniformly through the saddle flap, without constricting circulation.

Because the wristwatch 12 is loosely secured around the wrist, and since its position in within the viewing window 22 is stabilized by engagement of the watch body 24 against the saddle flap 44 and against the two-ply marginal side portions defined along the curved cut-out boundary line 34, the wristwatch can be worn without constricting circulation around the wrist and without turning or slipping of the watch from the operative display position.

Figure 8:
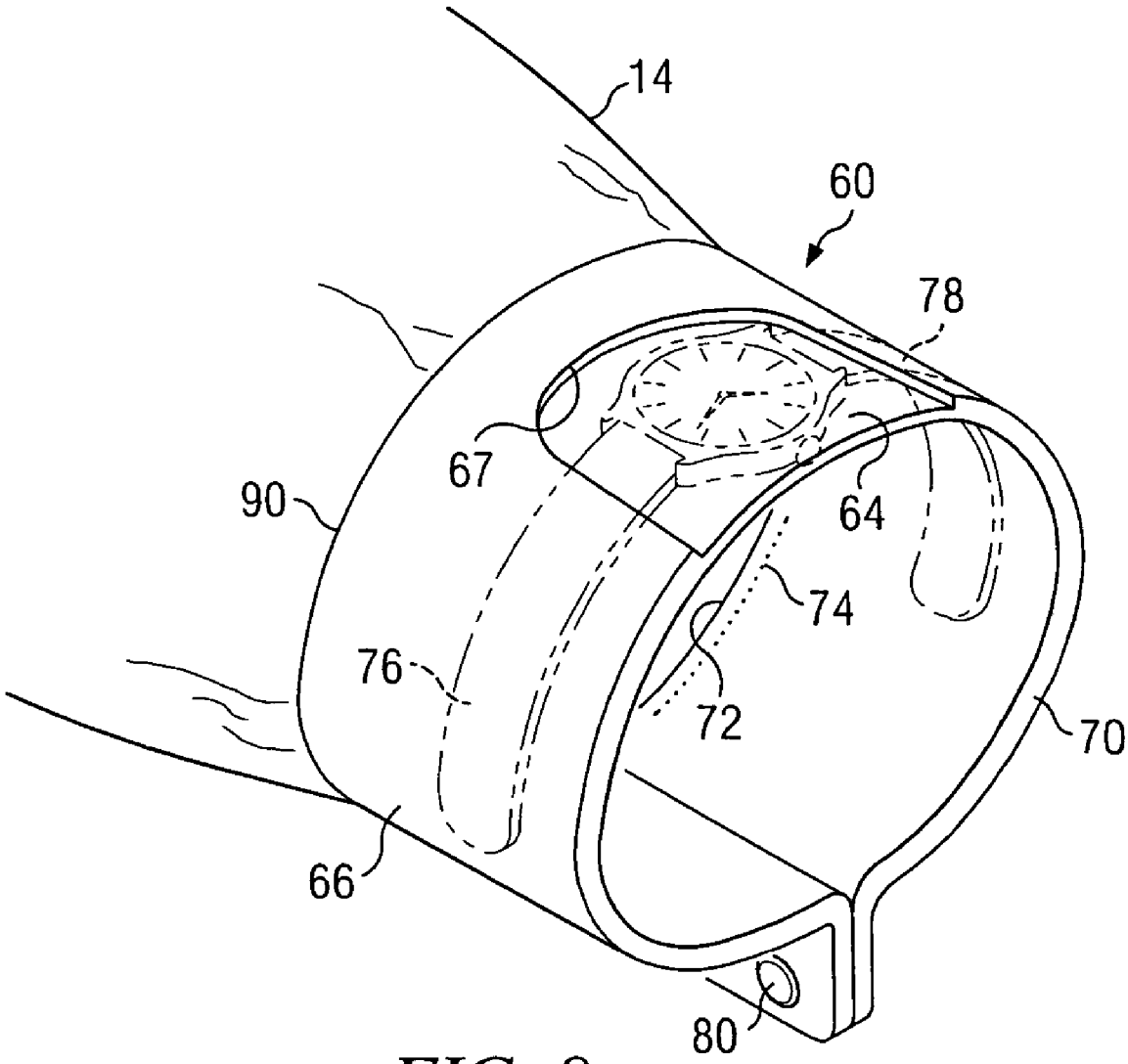
FIG. 8 is a perspective view of an alternative French cuff extension embodiment.
Figure 9:
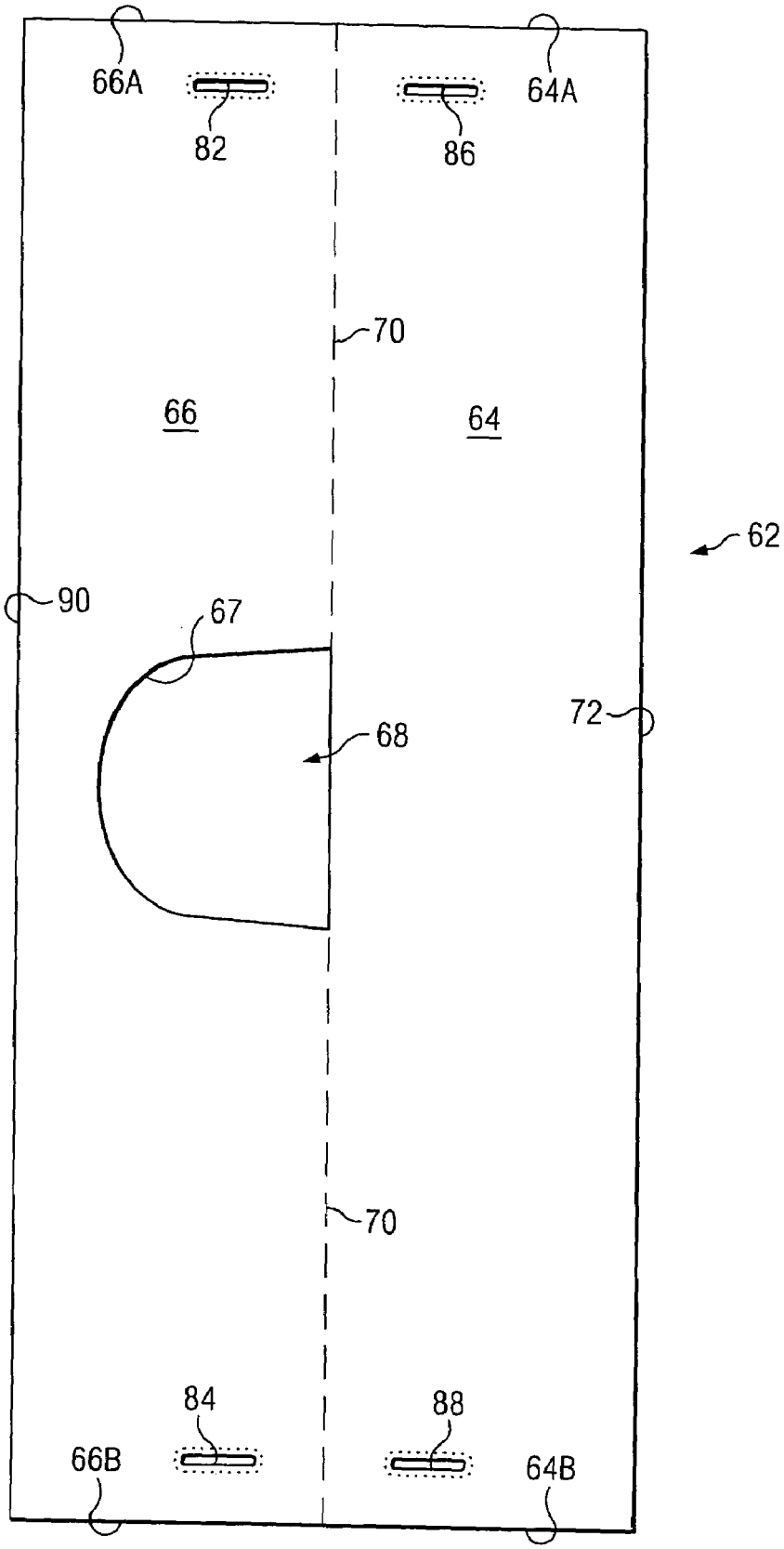
FIG. 9 is a top plan view thereof.

According to an alternative embodiment of the invention as shown in FIG. 8, a watch cuff 60 is provided by a fabric band 62 that is foldable to form the inner and outer layers 64, 66 of a French-style cuff. The outer layer 66 of the band is intersected along a cut-out line 67 defining a window opening 68 through which a conventional wristwatch can be viewed and accessed. The inner layer 64 of the French cuff serves as a saddle for engaging and supporting a watch body in registration with the cut-out window opening 68, thus providing convenient viewing and access. In this embodiment, the forces imposed by an expansion band or strap engagement are spread substantially uniformly through the inside French cuff layer 64, thus avoiding the constriction effects of retaining strap engagement forces, while preventing direct contact by the watch body against the wearer's wrist.

The fabric band 62 is folded about an intermediate fold line 70 to form the overlapping inside and outside layers of the French cuff extension. The cut-out window opening 68 is delimited at least in part by the fold line. The inner cuff layer 64 has a marginal edge portion 72 that is attached by stitching 74 onto the shirt sleeve 14.

After a wristwatch 12 is positioned on the inner cuff layer 64 in alignment with the viewing window 68, the outer cuff layer 66 is folded over as shown in FIG. 8. The watch 12 is fitted with resilient side clasps 76, 78, which are held between the overlapping layers. The watch body 24 framed within the viewing window 68 and is stabilized in the operative viewing position by frictional and clamping engagement imposed against the watch clasps by the overlapping French cuff layers 64, 66.

Preferably, the French cuff band 62 is cut from a swatch of 100 percent woven cotton yarn, and is folded and rolled to encircle the wrist of a wearer. Side edge portions 64A, 64B and 66A, 66B of the cuff band are gathered and secured together around the wrist by engagement of a cuff link 80 through button holes 82, 84 formed in the outer cuff layer 66 that are aligned in registration with button holes 86, 88 formed in the inner cuff layer 64. The outer cuff layer 66 has a marginal edge portion 90 that overlaps the inner cuff layer 64 approximately in alignment with the marginal edge 72 in the folded position.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

I claim:

1. A long-sleeved garment with wristwatch accommodations comprising, in combination:

a sleeve;

a cuff attached to the sleeve for allowing convenient viewing of the wristwatch in an operative viewing position, the cuff including a cuff band for encircling the wearer's wrist, wherein an opening defining a viewing window is formed in the cuff band for displaying the body of a wristwatch worn in an operative viewing position;

a flap attached to the cuff band, the flap extending beneath the viewing window in subjacent relation with the cuff band for engaging the underside of a wristwatch as it is being worn in an operative viewing position; and the cuff band including a proximal edge portion attached to the sleeve and a distal edge portion, wherein the flap comprises a swatch of fabric material that is bounded on one side by a peripheral edge portion, and the peripheral edge portion of the flap is aligned with the distal edge portion of the cuff band.

2. A garment according to claim 1, wherein the cuff band comprises a proximal edge portion attached to the sleeve and a distal edge portion forming the end of a barrel cuff extension, and wherein the cutout opening intersects the distal edge portion of the cuff band.

3. A garment according to claim 1, wherein the cuff band is delimited by a first edge portion that defines a distal end of the cuff and by a second edge portion that forms a boundary of the window opening.

4. A garment according to claim 1, wherein the flap is disposed in under lapping relation with the cuff band for spreading the forces of wristwatch expansion band or strap engagement more or less uniformly around a substantial portion of the wearer's wrist.

5. A garment according to claim 1, wherein a portion of the flap is spaced from the cuff band thereby providing a ventilation passage between the wearer's wrist and the body of a wristwatch disposed in the operative viewing position.

6. A garment according to claim 1, wherein the flap comprises a layer of moisture absorbent material interposed between a wearer's wrist and the body of a wristwatch worn in the operative viewing position.

7. A garment according to claim 1, wherein the flap is attached to the cuff band in depending relation therewith.

8. A garment according to claim 1, wherein the flap comprises a swatch of two-ply fabric material.

9. A garment according to claim 1, wherein the flap comprises a two-ply woven fabric material having a yarn threads per-inch count in the range of from about 80 threads per-inch to about 220 threads per-inch.

10. A garment according to claim 1, wherein the flap comprises 100 percent cotton yarn.

11. A garment according to claim 1, wherein the cuff band is folded and gathered to form overlapping inside and outside layers of a French cuff extension, and the outside French cuff layer is intersected by the cutout opening.

12. A garment according to claim 1, wherein the flap comprises a flexible body portion movably coupled to the underside of the cuff band.

13. A garment according to claim 1, wherein the flap comprises a swatch of fabric material that is bounded on one side by a side edge portion, and the side edge portion is attached to the underside of the cuff band on laterally opposing sides of the viewing window.

14. A garment according to claim 1, wherein the cuff band includes a first edge portion attached to the shirt sleeve and a second edge portion capable of being shaped and gathered to encircle the wearer's wrist, and wherein the cutout opening intersects the second edge portion of the cuff band.

15. A garment according to claim 1, wherein the cuff band includes a first edge portion attached to the shirt sleeve and a second edge portion capable of being shaped and gathered to encircle the wearer's wrist, and wherein the flap is stitched to the underside of the cuff band along the second peripheral edge portion.

* * * * *